United States Patent [19]

Morishita et al.

[11] 4,265,978

[45] May 5, 1981

[54] HEAT-SENSITIVE RECORDING PAPER IMPROVED IN KEEPING QUALITY OF GROUND COLOR

[75] Inventors: Sadao Morishita; Fumio Okumura; Masahiro Higuchi, all of Tokyo, Japan

[73] Assignee: Mitsubishi Paper Mills, Ltd., Tokyo, Japan

[21] Appl. No.: 75,685

[22] Filed: Sep. 13, 1979

[30] Foreign Application Priority Data

Sep. 20, 1978 [JP] Japan ..... 53/115322

[51] Int. Cl.[3] ..... B41M 5/18

[52] U.S. Cl. ..... 428/537; 8/116 R; 8/125; 282/27.5; 427/151; 427/153; 428/409; 428/913

[58] Field of Search ..... 282/27.5; 427/150, 151, 427/153, 303, 326; 428/307, 411, 409, 537, 913, 914; 8/116 R, 125, 495, 496; 106/210, 214; 162/134, 162

[56] References Cited

U.S. PATENT DOCUMENTS

| | | | |
|---|---|---|---|
| 3,773,542 | 11/1973 | Hayashi et al. | 282/27.5 |
| 3,852,093 | 12/1974 | O'Leary | 282/27.5 |
| 4,111,461 | 9/1978 | Leuensalor | 282/27.5 |

*Primary Examiner*—Bruce H. Hess

*Attorney, Agent, or Firm*—Cushman, Darby & Cushman

[57] ABSTRACT

A heat-sensitive recording paper in which a necessary heat-sensitive image-forming layer is provided on a neutral or alkaline paper prepared by practising the sizing process by the use of a combination of anionic sizing agent and cationic fixing agent, a combination of reactive sizing agent and neutral fixing agent or a self-fixable cationic sizing agent is improved in the keeping quality of ground color so that the ground is protected against coloration for a long period of time even at high temperature at high humidity or at high temperature, which enables to use 3-pyrrolidino-6-methyl-7-anilino-fluoran or 3-N-methylcyclohexylamino-6-methyl-7-anilinofluoran as a color-forming agent in combination with Bisphenol A as an acidic color-developing agent.

12 Claims, No Drawings

HEAT-SENSITIVE RECORDING PAPER IMPROVED IN KEEPING QUALITY OF GROUND COLOR

This invention relates to a heat-sensitive recording paper, and particularly to a heat-sensitive recording paper improved in keeping quality of ground color.

As recording processes using heat-sensitive recording system, those by the use of heat-sensitive recorder, heat-sensitive facsimile, heat-sensitive copying machine and the like can be referred to. Heat-sensitive method has many characteristic features such that it is non-impact type and emits no noise at the time of recording, that it necessitates no development nor fixation, that maintenance and control of instruments are simple, etc., so that the demand for this system has largely extended in recent years particularly in the field of facsimile.

The recording materials used in heat-sensitive recording systems include (1) a material which comprises coating carbon or a colored dye or pigment on a support and then coating an opaque, thermally fusible material thereon, by which the opaque layer becomes transparent upon being heated and an image is formed from the colored underlayer, (2) a material containing an electron-donating material and an electron-accepting material which form a complex by reacting with each other under heat, and (3) a material containing a discontinuous dispersion of a dye precursor such as crystal violet lactone and an acidic color-developing agent such as phenolic compound which, upon being heated, allows dissolution of one or both members and thereby mixing, reaction and color-formation. Among these materials, (3) seems to be most hopeful in the future from the general point of view particularly in respect of clarity of image, resolving power, color tone of image, the problem of deposit on heated pen, etc. Generally speaking, heat-sensitive recording papers of type (3) are manufactured by separately pulverizing and dispersing an acidic color-developing agent such as phenolic compound and a dye precursor, respectively, into the form of fine particles by means of ball mills, mixing respective dispersions with a binder, coating the mixtures onto a support such as paper and, if necessary, passing the coated paper through a supercalender in order to smooth the coated surface.

The term "keeping quality" of ground color used in this invention means the resistance of ground color, which is white just after manufacture, to (1) the gradual coloration during longterm storage after manufacture (hereinafter referred to as "longterm keeping quality"), (2) the coloration occurring when the recording paper is kept at a high temperature and a high humidity (for example, 45° C., 90% RH) (hereinafter referred to as "wet heat fogging") and (3) the coloration occurring when the recording paper is kept at a high temperature for a long period of time (for example, 60° C., 24 hours) (hereinafter referred to as "heat fogging"). Such wet heat fogging and heat fogging of heat-sensitive recording paper are originated from the fact that facsimile machine itself is required to resist such conditions, and it is originally unreasonable to require such properties of a heat-sensitive recording paper which develops a color upon being heated.

The present inventors conducted earnest studies with the aim of improving of the keeping quality of ground color. As the result, it was found that the combination of dye precursor and acidic color developing agent exercises a great influence upon keeping quality of ground color and, at the same time, that even if a combination is poor in keeping quality of ground color it can be made sufficiently practical by selecting the support appropriately. Based on these findings, this invention was accomplished.

Heretofore, the term "paper" predominantly means the so-called acidic paper obtained by fixing rosin size, petroleum resin size or the like with aluminum sulfate, aluminum chloride or the like. In the field of heat-sensitive recording paper, such acidic papers have been used.

These acidic papers are affected by $SO_4^{--}$ ion, $Cl^-$ ion, and acids formed by the deterioration of pulp such as formic and acetic acids. Probably for this reason, when used as a heat-sensitive recording paper, acidic papers are impractical particularly in point of wet heat fogging and heat fogging, depending on the combination of dye precursor and acidic color-developing agent.

In general, as acidic color-developing agent in heat-sensitive recording paper, there are used, for example, 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenebis(2-methylphenol), 4,4'-ethylenebis-(2-methylphenol), 1,1-bis(4'-hydroxyphenyl)cyclohexane, 2,2-bis(4'-hydroxyphenyl)propane, 4,4'-cyclohexylidenebis-(2-isopropylphenol), novolac type phenolic resin, 3,5-di-t-butylsalicylic acid, 3,5-di-α-methylbenzylsalicylic acid, 3-methyl-5-t-butylsalicylic acid, phthalic acid monoanilide, p-ethoxybenzoic acid, p-benzyloxybenzoic acid and the like.

Among these acidic color-developing agents, those susceptible to fogging of ground color during storage are 2,2-bis(4'-hydroxyphenyl)propane (hereinafter referred to as Bisphenol A), 4-phenylphenol, 4-hydroxyacetophenone, 2,2'-dihydroxydiphenyl, phthalic acid monoanilide, p-ethoxybenzoic acid and the like.

Among them, Bisphenol A is industrially used in heat-sensitive recording papers today. Since it is inexpensive and readily available, Bisphenol A is one of the typical compounds used as acidic color-developing agent for heat-sensitive recording paper. However, it has so high a water-solubility as about 0.1% at 50° C., so that it is a color-developing agent giving a particularly great wet heat fogging. Nevertheless, it is an important problem in the field of heat-sensitive recording paper to make an ingenious use of such Bisphenol A because of its inexpensiveness. The present inventors have succeeded in making an ingenious use of Bisphenol A by employing the support according to this invention.

On the other hand, typical examples of dye precursor for heat-sensitive recording paper include crystal violet lactone, 3-indolino-3-p-dimethylaminophenyl-6-dimethylaminophthalide, 3-diethylamino-7-chlorofluoran, 3-diethylamino-7-cyclohexylaminofluoran, 3-diethylamino-5-methyl-7-t-butylfluoran, 3-diethylamino-6-methyl-7-anilinofluoran, 3-diethylamino-6-methyl-7-(p-n-butylanilino)fluoran, 3-diethylamino-7-dibenzylaminofluoran, 3-cyclohexylamino-6-chlorofluoran, 3-diethylamino-6-methyl-7-xylidinofluoran, 2-anilino-3-methyl-6-(N-ethyl-p-toluidino)fluoran, 3-pyrrolidino-6-methyl-7-anilinofluoran, 3-pyrrolidino-7-cyclohexylaminofluoran, 3-piperidino-6-methyl-7-toluidinofluoran, 3-pyrrolidino-6-methyl-7-(p-toluidino)fluoran, 3-piperidino-6-methyl-7-anilinofluoran, 3-N-methylcyclohexylamino-6-methyl-7-anilinofluoran, 3-diethylamino-7-(m-trifluoromethylanilino)fluoran and the like. Among them, dye precursors giving particularly great wet heat fogging, heat fogging or longterm storage fogging when combined with an acidic color-developing agent showing a tendency to increase wet heat fogging or heat fogging, as mentioned above, such as Bisphenol A are 3-pyrrolidino-6-methyl-7-anilinofluoran, 3-N-methylcyclohexylamino-6-methyl-7-anilinofluoran and the like. If the dye precursors exemplified by these two members are used, there is a limit in the improvement of keeping quality of ground color however the formulation of heat-sensitive coating liquid may be changed, so long as the so-called acidic paper is used as the support. These dye precursors have first required practicability only by the use of the support of this invention.

It is the object of this invention to provide a heat-sensitive recording paper improved in keeping quality of ground color which comprises a combination of 3-pyrrolidino-6-methyl-7-anilinofluoran or 3-N-methylcyclohexylamino-6-methyl-7-anilinofluoran and Bisphenol A.

According to this invention, there is provided a heat-sensitive recording paper improved in keeping quality of ground color which comprises a support, a dye precursor constituted of 3-pyrrolidino-6-methyl-7-anilinofluoran and/or 3-N-methylcyclohexylamino-6-methyl-7-anilinofluoran and an acidic color-developing agent constituted of 2,2-bis(4'-hydroxyphenyl)propane, said dye precursor and said acidic color-developing agent being provided on said support, characterized in that said support is a paper which has been sized so as to become neutral or alkaline during wet paper making.

Hereunder, the support of this invention will be illustrated. As used in this invention, the term "support" means a neutral or alkaline paper which has been made into paper by using neither aluminum sulfate nor aluminum chloride which are fixing agents generally used during sizing in the paper-making industry.

Such paper can be obtained by practising the sizing methods mentioned below in the process of paper-making:

(1) A paper-making method using a anionic sizing agent and a cationic fixing agent.

(2) A paper-making method using a reactive sizing agent.

(3) A paper-making method using a cationic sizing agent having self-fixability.

According to method (1), an anionic sizing agent such as rosin or petroleum resin, conventionally subjected to acidic fixation by the use of aluminum sulfate, is fixed with a cationic fixing agent in neutral or alkaline condition to complete the sizing.

Example of the reactive sizing agent used in method (2) is alkylketene dimer, distearic acid anhydride, alkenylsuccinic acid anhydride or the like. The paper-making is carried out under a neutral condition by the use of a fixing agent such as cationic starch or the like.

The self-fixable cationic sizing agent used in method (3) is water-soluble polymer having quaternary ammonium salt residue. Method (3) generally covers the use of nitrogen-containing vinyl monomer, the method using a compound obtainable by modifying a reaction product of maleic anhydride with an amino compound, and a method using a compound synthesized by aminating a compound having methyl chloride group. As the agent for converting these amino resin compounds to quaternary ammonium salts, there are disclosed benzyl chloride, alkyl chloride, dimethyl sulfate, epichlorohydrin and the like.

As the sizing agents used in this invention, the following products commerciallized by the following makers under the commercial names mentioned below can be used, although this invention is not limited by them.

| Commercial name | Seller | Chemical composition |
|---|---|---|
| Fibran 68 | National Starch Co. | Alkenylsuccinic acid anhydride |
| Hersize CP-800 | Harima Kasei K.K. | Synthetic product of rosin, styrene, etc. |
| GZ-1200 | Hamano Kogyo K.K. | α-Olefin-maleic anhydride copolymer |
| Homosize 7A | Kindai Kagaku K.K. | Petroleum resin type |
| Pearlgum CS | Seiko Kagaku K.K. | Styrene-acryl type copolymer |
| Aquapel 360XC | Dick-Hercules Co. | Alkylketene dimer |
| Basoplast 280D | B.A.S.F. | Acryl copolymer |

As the cationic polymer compound used as a fixing agent in the sizing, the following products commercialized by the following makers under the commercial names mentioned below can be used, though the invention is not limited by them.

| Commercial name | Seller | Chemical composition |
|---|---|---|
| Polymin P | B.A.S.F. | Polyethyleneimine compound |
| Cartaletin F | Sandoz Co. | Polyamide-amine compound |
| Stargum FN | Seiko Kagaku K.K. | Polyacrylamide compound |
| DC-7 | Hamano Kogyo K.K. | Polyacrylamide compound |
| MK-4200 | Mitsubishi Kasei K.K. | Acrylamide-acrylic ester copolymer |
| Lethaminol K | Bayer Co. | Polyamine compound |
| Epomine P-1500 | Nihon Shokubai Kagaku K.K. | Polyethyleneimine compound |
| Acoflock C | Mitsui Toatsu Kagaku K.K. | Acrylamide compound |
| Pearlflock FR | Seoko Kagaku K.K. | Polyacrylamide compound |
| CATO-F | National Starch | Cationic starch |
| Arafix 500 | Arakawa Kagaku K.K. | Polyacrylamide |
| KL-11 | Kyoritsu Yuki Kogyo K.K. | Polyacrylamide |
| Epinox | Dick-Hercules | Polyamino-polyamide-epichlorohydrin |
| Kymen | Dick-Hercules | Polyamine-polyamide-epichlorohydrin |

In general, a sizing agent and a fixing agent are used at a ratio of 1:0.05–4 and preferably 1:0.1–2. The sizing agent is used in an amount of 0.1 to 2.0% by weight and the fixing agent is in an amount of 0.2 to 2.0% by weight both based on pulp.

In this invention, an inorganic pigment or a clay such as aluminum hydroxide, calcium carbonate, zinc oxide, titanium oxide, barium sulfate, silica gel, activated clay, talc, clay, satin white, kaolinite, calcined kaolinite or the like and an organic filler such as polystyrene granule, polyolefin granule, urea-formaldehyde resin granule or the like may be incorporated into paper at will. Also, a yield-improver for these fillers may be used. As said filler, a filler of high oil absorption such as light weight calcium carbonate, calcined kaolinite, activated clay, silica gel, urea-formaldehyde resin granule or the like is preferably employed in order to improve the adsorption of the deposit attached to heat pen which forms from the melt of Bisphenol A or dye precursor at the time of facsimile printing. In this case, the filler is used in an amount of 5–25% and preferably 5–15% based on pulp. If its amount is more than 25%, the strength of paper drops, which is undesirable.

This invention will be illustrated in more detail by way of the following examples and comparative examples.

Example 1 illustrates the support of this invention, while Comparative Example 1 does the conventional acidic paper. Comparative Example 2 illustrates the same acidic paper as obtained in Comparative Example 1 except that it is further subjected to an alkaline undercoating processing. Example 2 and Example 3 illustrate the case in which a dye precursor poor in keeping quality of ground color is used. Comparative Example 3 and Comparative Example 4 are out of this invention in which a dye precursor good in keeping quality of ground color is used.

EXAMPLE 1

A pulp (LBKP 80%, NBKP 20%) was beaten with a beater to a degree of bearing of 400 CSF. To the beaten pulp was added 10%, based on the pulp, of light-weight calcium carbonate (commercial name Calcium Carbonate PC, a precipitated calcium carbonate manufactured by Shiraishi Kogyo K.K.) which was followed by 0.3%, based on the pulp, of Fibran 68 (manufactured by National Starch Co.) as a reactive sizing agent and 0.6%, based on the pulp, of cationic starch CATO-F (manufactured by National Starch Co.) as a fixing agent for the sizing agent, after which the mixture was made into a paper. The paper was passed through a machine calender to obtain a paper having a basis weight of 50 g/m$^2$, an opaqueness of 75%, a whiteness of 80% and a surface pH of 7.3.

COMPARATIVE EXAMPLE 1

A pulp (LBKP 80%, NBKP 20%) was beaten with beater to a degree of beating of 400 CSF. To the beaten pulp were added 10% of talc as a filler, 1.2% of rosin size as a sizing agent and 2.7% of aluminum sulfate as a freeness improver and a fixing agent, all based on the pulp, after which the mixture was made into a paper. It was passed through a machine calender to obtain an acidic paper having a basis weight of 50 g/m$^2$, an opaqueness of 73%, a whiteness of 70% and surface pH of 5.6.

COMPARATIVE EXAMPLE 2

A liquid of the following composition:

| | |
|---|---|
| Calcium carbonate | 80 g |
| Polyvinyl alcohol | 20 g |
| Water | 200 g |

was coated over the acidic paper obtained in Comparative Example 1 so as to give a dry coating weight of 8 g/m$^2$ and then dried. It was treated by means of supercalender to obtain a paper having a back side pH of 5.6 and a front side pH of 7.4.

EXAMPLE 2

The procedure of Example 1 was repeated, except that Pearlgum E (maleic acid-modified petroleum resin emulsion manufactured resin emulsion manufactured by Seiko Kagaku Co.) was added in an amount of 0.6% based on the pulp as an anionic sizing agent in place of the sizing agent Fibran 68 used in Example 1 and Polymin P (manufactured by B.A.S.F.) was added in an amount of 0.2% based on the pulp as a fixing agent for the sizing agent in place of cationic starch, CATO-F. Thus, there was obtained a paper having a basis weight of 50 g/m$^2$, an opaqueness of 74%, a whiteness of 79% and surface pH of 7.4.

EXAMPLE 3

The procedure of Example 1 was repeated, except that paper-making was carried out by adding calcined kaolinite in an amount of 8% based on the pulp in place of the light weight calcium carbonate used in Example 1, adding GZ-1200 (manufactured by Hamano Kogyo K.K.) as a self-fixable cationic sizing agent in an amount of 1% based on the pulp in place of sizing agent Fibran 68, and using no fixing agent. Thus, there was obtained a paper having a basis weight of 50 g/m$^2$, an opaqueness of 80%, a whiteness of 85% and surface pH of 6.7.

EXAMPLE 4

A dye dispersion was prepared by pulverizing and dispersing, by means of a ball mill, 30 g of 3-pyrrolidino-6-methyl-7-anilinofluoran together with 66.4 g of water and 3.6 g of 25% aqueous solution of sodium salt of styrene-maleic anhydride copolymer (Malon MS-25 manufactured by Daido Kogyo K.K.) for 20 hours.

On the other hand, a dispersion of color-developing agent was prepared by pulverizing and dispersing, by means of a ball mill, 45 g of Bisphenol A together with 49.6 g of water and 5.4 g of Malon MS-25 for 24 hours.

Then, using these dispersions, the following heat-sensitive coating liquid was prepared:

| | |
|---|---|
| Rice starch powder | 20 g |
| Dispersion of color-developing agent | 35.6 g |
| Malong MS-25 | 39 g |
| Dispersion of dye | 11 g |
| Water | 140 g |

The coating liquid thus obtained was coated over each of the papers obtained in Examples 1–3 and Comparative Examples 1–2 so as to give a dry coating weight of 6 g/m$^2$ and then dried. After treatment by means of supercalender, there were obtained 5 kinds of heat-sensitive recording papers.

EXAMPLE 5

5 kinds of heat-sensitive recording papers were prepared by repeating the procedure of Example 4, except that 3-N-methylcyclohexylamino-6-methyl-7-anilinofluoran was used as the dye precursor.

COMPARATIVE EXAMPLE 3

5 kinds of heat-sensitive recording papers were prepared by repeating the procedure of Example 4, except that 3-diethylamino-6-methyl-7-anilinofluoran, excellent in keeping quality of ground color, was used as the dye precursor.

COMPARATIVE EXAMPLE 4

5 kinds of heat-sensitive recording papers were prepared by repeating the procedure of Example 4, except that 3-diethylamino-7-(m-trifluoromethyl)-anilinofluoran, excellent in keeping quality of ground color, was used as the dye precursor.

The intensity of ground coloration 2 days after calendering (initial fogging), the intensity of ground coloration after standing for 24 hours at 45° C. at a humidity of 90% RH (wet heat fogging), the intensity of ground coloration after standing for 24 hours at 60° C. (heat fogging), the intensity of ground coloration after standing for 2 months at room temperature in the dark (long-term storage fogging) and the intensity of coloration at the time of being heated to 150° C. (150° C. color intensity) of the heat-sensitive recording papers obtained in Examples 4 and 5 and Comparative Examples 3 and 4 were measured by means of densitometer manufactured by Tokyo Koden K.K. The results are summarized in Table 1.

From these examples and comparative examples, it is understandable that the paper used in this invention is most suitable for use as the support and that an acidic paper itself is of course poor in keeping quality of ground color and alkaline undercoating of acidic paper is ineffective in point of keeping quality of ground color because of the influence of the acidic substance exercised from the backside of paper.

TABLE 1

| Heat sensitive[1] layer | Support[1] | Initial fogging | Wet heat fogging | Heat fog-ging | Longterm storage fogging | 150° C. color intensity |
|---|---|---|---|---|---|---|
| Ex. 4 | Ex. 1 | 0.07 | 0.14 | 0.12 | 0.13 | 1.16 |
| | C. Ex. 1 | 0.07 | 0.27 | 0.20 | 0.35 | 1.16 |
| | C. Ex. 2 | 0.07 | 0.25 | 0.18 | 0.30 | 1.10 |
| Ex. 5 | Ex. 1 | 0.04 | 0.12 | 0.08 | 0.09 | 1.24 |
| | C. Ex. 1 | 0.04 | 0.20 | 0.15 | 0.22 | 1.20 |
| | C. Ex. 2 | 0.04 | 0.18 | 0.13 | 0.19 | 1.22 |
| C. Ex. 3 | Ex. 1 | 0.03 | 0.08 | 0.06 | 0.07 | 1.10 |
| | C. Ex. 1 | 0.03 | 0.09 | 0.08 | 0.07 | 1.12 |
| | C. Ex. 2 | 0.03 | 0.09 | 0.07 | 0.07 | 1.12 |
| C. Ex. 4 | Ex. 1 | 0.02 | 0.03 | 0.03 | 0.06 | 1.16 |
| | C. Ex. 1 | 0.02 | 0.04 | 0.05 | 0.07 | 1.17 |
| | C. Ex. 2 | 0.02 | 0.04 | 0.05 | 0.07 | 1.17 |

[1]Ex.: Example; C. Ex.: Comparative Example

What is claimed is:

1. A heat-sensitive recording paper which comprises a support and at least one dye precursor selected from the group consisting of 3-pyrrolidino-6-methyl-7-anilinofluoran and 3-N-methylcyclohexylamino-6-methyl-7-anilinofluoran and 2,2-bis(4'-hydroxyphenyl)-propane as a color-developing agent on said support, characterized in that said support is a paper which has been sized so as to become neutral or alkaline during wet paper making, said sizing having been carried out by (1) the use of an anionic sizing agent and by means of fixation with a cationic fixing agent, (2) the use of a reactive sizing agent and a fixing agent therefor or (3) the use of a self-fixable cationic sizing agent.

2. A heat-sensitive recording paper according to claim 1, wherein the sizing has been carried out by the use of an anionic sizing agent and by means of fixation with a cationic fixing agent.

3. A heat-sensitive recording paper according to claim 2, wherein said anionic sizing agent is maleic acid-modified petroleum resin emulsion and said cationic fixing agent is polyethyleneimine.

4. A heat-sensitive recording paper according to claim 1, wherein the sizing has been carried out by the use of a reactive sizing agent and a fixing agent therefor.

5. A heat-sensitive recording paper according to claim 4, wherein said reactive sizing agent is alkylketene dimer, alkenylsuccinic acid anhydride or distearic acid anhydride and said fixing agent is cationic starch.

6. A heat-sensitive recording paper according to claim 2 or 4, wherein the ratio, by weight, of sizing agent to fixing agent is in the range of 1:0.05 to 1:4.

7. A heat-sensitive recording paper according to claim 1, wherein the sizing has been carried out by the use of a self-fixable cationic sizing agent.

8. A heat-sensitive recording paper according to claim 7, wherein said self-fixable cationic sizing agent is α-olefin-maleic anhydride copolymer.

9. A heat-sensitive recording paper according to claim 1, wherein the support contains an organic and/or inorganic adsorbent as a filler in an amount of 5–25% based on the support itself.

10. A heat-sensitive recording paper according to claim 9, wherein said filler is precipitated calcium carbonate.

11. A heat-sensitive recording paper according to claim 1 wherein when the sizing is by method (2) the fixing agent is a cationic starch.

12. A heat-sensitive recording paper according to claim 1 wherein the sizing has been carried out by the use of a reactive sizing agent and a cationic starch fixing agent therefor.

* * * * *